US010539005B2

(12) United States Patent
Lozinsky

(10) Patent No.: US 10,539,005 B2
(45) Date of Patent: Jan. 21, 2020

(54) DETERMINING GRAVITY TOOLFACE AND INCLINATION IN A ROTATING DOWNHOLE TOOL

(71) Applicant: Halliburton Energy Services, Inc., Houston, TX (US)

(72) Inventor: Clint P. Lozinsky, Nisku (CA)

(73) Assignee: Halliburton Energy Services, Inc., Houston, TX (US)

( * ) Notice: Subject to any disclaimer, the term of this patent is extended or adjusted under 35 U.S.C. 154(b) by 100 days.

(21) Appl. No.: 14/654,873

(22) PCT Filed: Dec. 27, 2012

(86) PCT No.: PCT/US2012/071851
§ 371 (c)(1),
(2) Date: Jun. 23, 2015

(87) PCT Pub. No.: WO2014/105025
PCT Pub. Date: Jul. 3, 2014

(65) Prior Publication Data

US 2015/0330210 A1 Nov. 19, 2015

(51) Int. Cl.
*E21B 47/024* (2006.01)

(52) U.S. Cl.
CPC ..... *E21B 47/024* (2013.01)

(58) Field of Classification Search
CPC ..... E21B 47/024; E21B 7/04; G01V 9/00; G01C 9/08; G01C 21/16
(Continued)

(56) References Cited

U.S. PATENT DOCUMENTS 4,665,748 A 5/1987 Peters
4,768,152 A 8/1988 Egli et al.
(Continued)

FOREIGN PATENT DOCUMENTS

GB 2135450 8/1984
GB 2432176 A 5/2007
WO 2007/014446 A1 2/2007

OTHER PUBLICATIONS

Michael Richmond, Physics 211 Lecture Angular and Tangential Quantities, Sep. 4, 2004, Rochester Institute of Technology.*
(Continued)

*Primary Examiner* — Justin Seo
*Assistant Examiner* — David L Singer
(74) *Attorney, Agent, or Firm* — Jason Sedano; Baker Botts L.L.P.

(57) ABSTRACT

Systems and methods for determining gravity toolface and inclination are described herein. An example may comprise a downhole tool (300) and a sensor assembly (330, 340, 350) disposed in a radially offset location within the downhole tool. The sensor assembly may comprise three accelerometers and an angular rate sensing device. A processor (402*a*) may be in communication with the sensor assembly and may be coupled to at least one memory device (402*b*). The memory device may contain a set of instruction that, when executed by the processor, cause the processor to receive an output from the sensor assembly; determine at least one of a centripetal acceleration (r) and a tangential acceleration (a) of the downhole tool based, at least in part, on the output; and determine at least one of a gravity toolface and inclination of the downhole tool using at least one of the centripetal acceleration and the tangential acceleration.

18 Claims, 3 Drawing Sheets

(58) Field of Classification Search
USPC ..... 73/152.46, 504.03, 1.75, 510–512; 166/255.2; 33/313; 175/45
See application file for complete search history.

(56) References Cited

U.S. PATENT DOCUMENTS

| | | | | |
|---|---|---|---|---|
| 5,501,285 | A * | 3/1996 | Lamine | E21B 10/60 175/27 |
| 5,720,355 | A * | 2/1998 | Lamine | E21B 10/60 175/27 |
| 6,453,239 | B1 * | 9/2002 | Shirasaka | E21B 47/022 175/45 |
| 6,516,898 | B1 | 2/2003 | Krueger | |
| 6,518,756 | B1 * | 2/2003 | Morys | E21B 47/00 324/300 |
| 6,823,602 | B2 | 11/2004 | Noureldin et al. | |
| 7,195,062 | B2 | 3/2007 | Cairns et al. | |
| 7,938,004 | B1 * | 5/2011 | Brunsch, Jr. | G01C 21/16 701/10 |
| 8,028,764 | B2 * | 10/2011 | Teodorescu | E21B 12/02 175/40 |
| 2002/0005297 | A1 * | 1/2002 | Alft | E21B 7/046 175/26 |
| 2002/0133958 | A1 * | 9/2002 | Noureldin | E21B 47/022 33/304 |
| 2003/0183423 | A1 * | 10/2003 | Brazil | E21B 7/04 175/61 |
| 2003/0196490 | A1 * | 10/2003 | Cardarelli | G01C 19/56 73/504.02 |
| 2004/0089474 | A1 * | 5/2004 | Noureldin | G01C 21/16 175/45 |
| 2004/0245017 | A1 * | 12/2004 | Chen | E21B 44/00 175/41 |
| 2005/0150689 | A1 * | 7/2005 | Jogi | E21B 7/06 175/45 |
| 2005/0194183 | A1 * | 9/2005 | Gleitman | E21B 17/07 175/45 |
| 2005/0269082 | A1 * | 12/2005 | Baron | E21B 7/04 166/255.2 |
| 2006/0006000 | A1 * | 1/2006 | Weston | E21B 7/04 175/45 |
| 2006/0248735 | A1 * | 11/2006 | Haugland | E21B 47/022 33/304 |
| 2007/0107937 | A1 * | 5/2007 | Sugiura | E21B 7/062 175/45 |
| 2007/0289373 | A1 * | 12/2007 | Sugiura | E21B 7/062 73/152.46 |
| 2008/0201969 | A1 | 8/2008 | Davies et al. | |
| 2008/0230273 | A1 * | 9/2008 | Brooks | E21B 47/024 175/45 |
| 2009/0007661 | A1 * | 1/2009 | Nasiri | G01P 1/023 73/504.03 |
| 2009/0194332 | A1 * | 8/2009 | Pastusek | E21B 21/08 175/40 |
| 2009/0222209 | A1 * | 9/2009 | Morys | G01V 11/005 702/9 |
| 2009/0287451 | A1 | 11/2009 | Sato et al. | |
| 2010/0097890 | A1 * | 4/2010 | Sullivan | E21B 17/028 367/82 |
| 2010/0108380 | A1 * | 5/2010 | Teodorescu | E21B 10/00 175/24 |
| 2012/0218118 | A1 * | 8/2012 | Weston | E21B 19/00 340/853.8 |
| 2013/0092439 | A1 * | 4/2013 | Mauldin | E21B 44/00 175/40 |
| 2013/0105224 | A1 * | 5/2013 | Donderici | G01V 3/30 175/45 |
| 2013/0124095 | A1 * | 5/2013 | Sugiura | G06F 19/00 702/9 |
| 2014/0102795 | A1 * | 4/2014 | VanSteenwyk | E21B 47/02216 175/45 |

OTHER PUBLICATIONS

Diffen.com, Centrifugal Force vs Centripetal Force, Nov. 30, 2012.*
Allain, 2009, Centripetal Force, Centrifugal Force—what's the deal?, Dot Physics.*
Allain, Centripetal vs. Centrifugal (word origins), Dot Physics.*
Strang, Calculus, 1991, Wellesley-Cambridge Press, Chapters 2 & 12.*
Semat et al, 1958, Physics, Chapter 6: Circular Motion and Gravitation Robert Katz Publications.*
Encyclopedia.com, 2002 centripetal force and centrifugal force facts, information, pictures.*
Plait, When I say centrifugal, I mean centrifugal!, 2006, Bad Astronomy.*
SFSU Physics 111 homework solutions for HW#5a, 2011.*
HighBeam Research, Halliburton Completes MWD Gyro Service Field Test (Year: 2004).*
IADC Drilling Manual, Evolution of directional drilling since 1900 (Year: 2015).*
Laserlith Corporation, Improved Directional Drilling Technology for the Bakken Formation (Year: 2009).*
Tang, Improved Directional Drilling Technology for the Bakken Formation Contract (Year: 2011).*
EPSON, Gyro sensors—How they work and what's ahead (Year: 2015).*
Watson Industries, Rate Gyros Archives—Gyros & Inertial Sensor (Year: 2015).*
Vectornav, VectorNav Library: Gyroscope (Year: 2014).*
Halliburton, Sperry's Directional Drilling and Measurement-While-Drilling Services Key in Piceance Basin Tight Gas (Year: 2009).*
Halliburton, Talisman Uses Sperry's Evader® Gyro-While-Drilling Service to Avoid Downhole Collisions and Reduce Costs (Year: 2008).*
Budapest University, Inertial Sensors Gyroscopes, EE 570: Location and Navigation: Theory & Practice (Year: 2011).*
International Preliminary Report on Patentability issued in related PCT Application No. PCT/US2012/071851, dated Jul. 9, 2015 (8 pages).
International Search Report and Written Opinion issued in related PCT Application No. PCT/US2012/071851 dated Sep. 17, 2013, 11 pages.
Noureldin et al , "Measurement-while-drilling surveying of highly inclined and horizontal well sections utilizing single-axis gyro sensing system", Institute of Physics Publishing, Nov. 19, 2004.

* cited by examiner

DETERMINING GRAVITY TOOLFACE AND INCLINATION IN A ROTATING DOWNHOLE TOOL

CROSS-REFERENCE TO RELATED APPLICATION

The present application is a U.S. National Stage Application of International Application No. PCT/US2012/071851 filed Dec. 27, 2012, which is incorporated herein by reference in its entirety for all purposes.

BACKGROUND

The present disclosure relates generally to well drilling operations and, more particularly, to systems and methods for determining gravity toolface and inclination in a rotating downhole tool.

In certain subterranean operations it may be beneficial to determine the rotational orientation and inclination of a downhole tool position in a borehole. In drilling operations that require steering the drill bit to a particular target, knowing the inclination and orientation of the drill bit may be essential. A gravity toolface measurement may be used to determine the rotational orientation of a downhole tool relative to the high side of a borehole. Accelerometers may be used for gravity toolface and inclination measurements, but any rotation of the tool during the measurement process may skew the measurements. This is particularly problematic in rotary steerable drilling systems, where electronics are located in a rotating portion of the drilling assembly. Current methods for correcting the rotational skew in the measurements typically require up to six accelerometers disposed in multiple radial and or axial locations along a tool.

FIGURES

Some specific exemplary embodiments of the disclosure may be understood by referring, in part, to the following description and the accompanying drawings.

Figure 1:
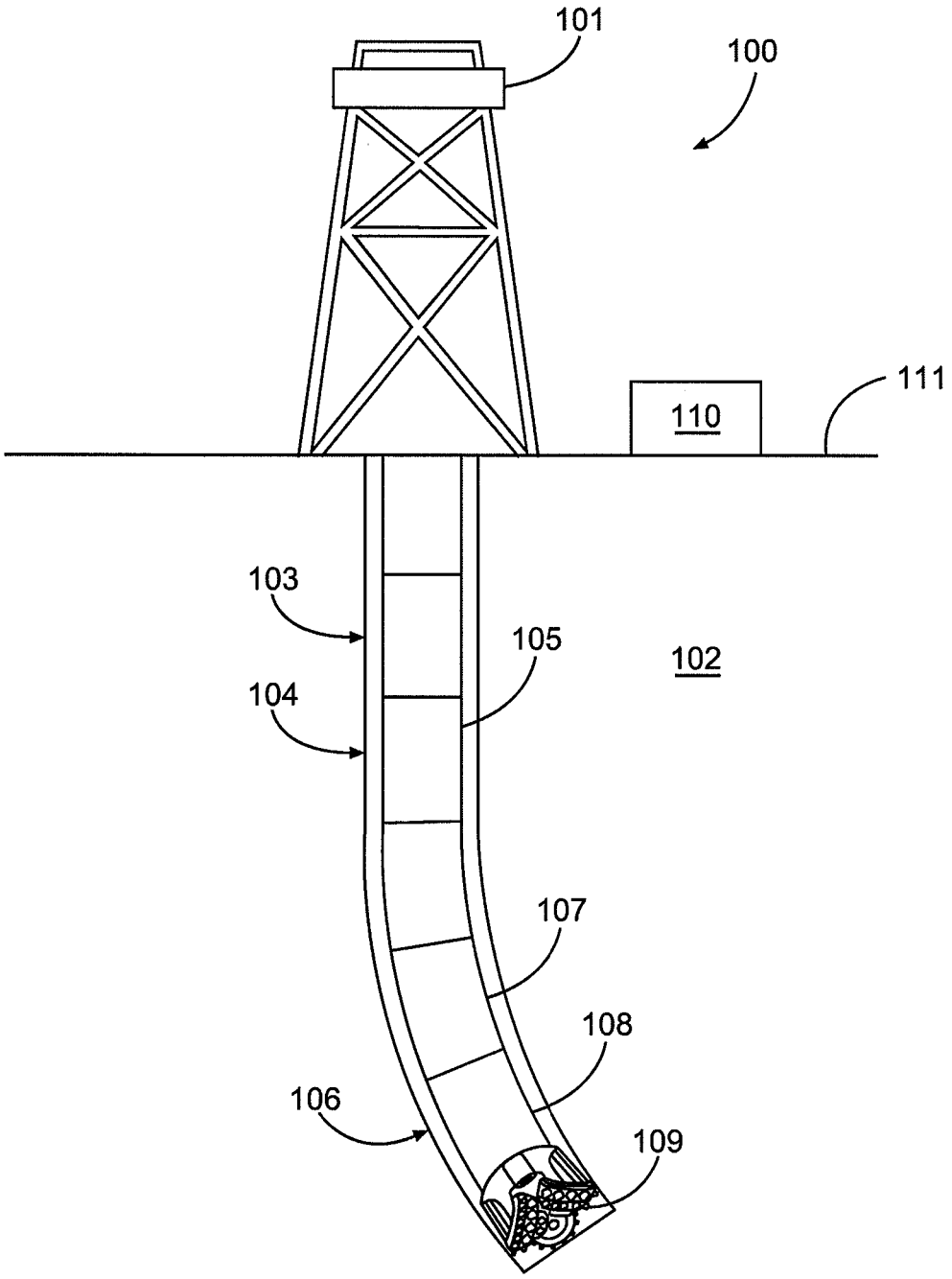
FIG. 1 is a diagram illustrating an example drilling system, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well drilling operations and, more particularly, to systems and methods for determining gravity toolface and inclination in a rotating downhole tool. In one aspect, the systems and methods have more favorable geometric feasibility than a conventional solution requiring six accelerometers.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to drilling operations that include horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as borehole construction for river crossing tunneling and other such tunneling boreholes for near surface construction purposes or borehole u-tube pipelines used for the transportation of fluids such as hydrocarbons. Embodiments described below with respect to one implementation are not intended to be limiting.

Embodiments of various systems and methods for determining gravity toolface and inclination are described herein. An example may comprise a downhole tool and a sensor assembly disposed in a radially offset location within the downhole tool. The sensor assembly may comprise three accelerometers and an angular rate sensing device. A processor may be in communication with the sensor assembly and may be coupled to at least one memory device. The memory device may contain a set of instruction that, when executed by the processor, cause the processor to receive an output from the sensor assembly, to determine at least one of a centripetal acceleration and a tangential acceleration of the downhole tool based, at least in part, on the output, and to determine at least one of a gravity toolface and inclination of the downhole tool using at least one of the centripetal acceleration and the tangential acceleration.

Another example system for determining gravity toolface and inclination may also comprise a downhole tool. A first sensor assembly may be disposed in a first radially offset location within the downhole tool. The first sensor assembly may comprise a first accelerometer and a second accelerometer. A second sensor assembly may be disposed in a second radially offset location within the downhole tool. The second sensor assembly may comprise a third accelerometer and a fourth accelerometer. A processor may be in communication with the first sensor assembly and the second sensor assembly, and coupled to at least one memory device. The memory device may contain a set of instruction that, when executed by the processor, cause the processor to receive a first output from the first sensor assembly and a second output from the second sensor assembly, determine at least one of a centripetal acceleration and a tangential acceleration of the downhole tool based, at least in part, on the first output and the second output, and determine at least one of a gravity toolface and inclination of the downhole tool using at least one of the centripetal acceleration and the tangential acceleration.

FIG. 1 is a diagram illustrating an example drilling system 100, according to aspects of the present disclosure. The drilling system 100 includes rig 101 at the surface 111 and positioned above borehole 103 within a subterranean formation 102. Rig 101 may be coupled to a drilling assembly 104, comprising drill string 105 and bottom hole assembly (BHA) 106. The BHA 106 may comprise a drill bit 109, steering assembly 108, and an MWD apparatus 107. A control unit 114 at the surface may comprise a processor and memory device, and may communicate with elements of the BHA 106, in MWD apparatus 107 and steering assembly 108. The control unit 114 may receive data from and send control signals to the BHA 106. Additionally, at least one processor and memory device may be located downhole within the BHA 106 for the same purposes. The steering assembly 108 may comprise a rotary steerable drilling system that controls the direction in which the borehole 103 is being drilled, and that is rotated along with the drill string 105 during drilling operations. In certain embodiments, the steering assembly 108 may angle the drill bit 109 to drill at an angle from the borehole 104. Maintaining the axial position of the drill bit 109 relative to the borehole 104 may require knowledge of the rotational position of the drill bit 109 relative to the borehole. A gravity toolface measurement may be used to determine the rotational orientation of the drill bit 113/steering assembly 108.

Figure 2:
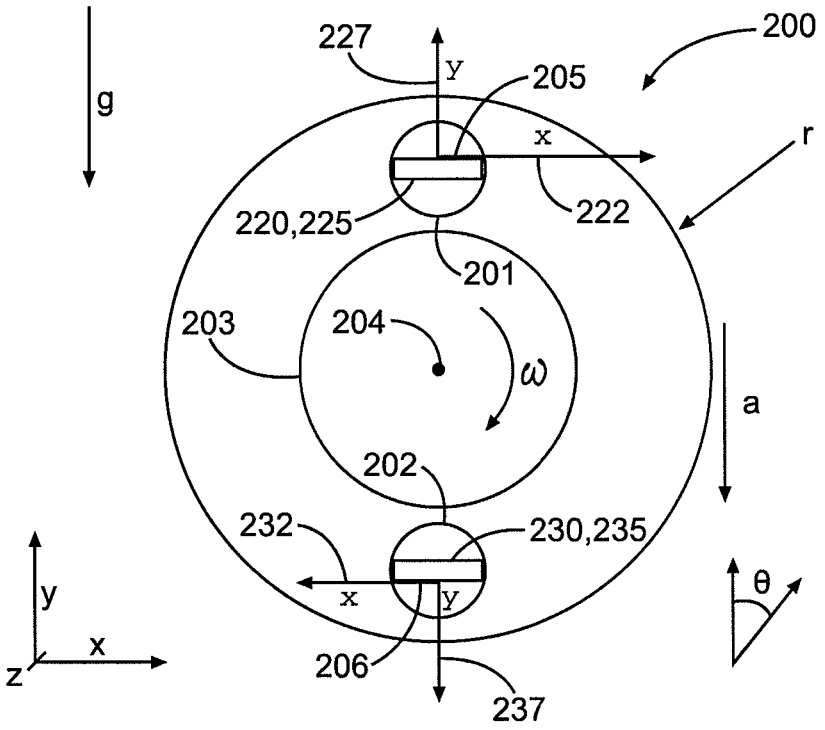
FIG. 2 is a diagram illustrating an example downhole tool, according to aspects of the present disclosure.

According to aspects of the present disclosure, a sensor assembly may be incorporated into the drilling assembly 109 to determine both the gravity tool face and inclination of the drilling assembly during drilling operations, while the drilling assembly is rotating. The sensor assembly described herein is not limited to determining the gravity toolface and inclination of a steering assembly, and may be used in a variety of downhole operations. In certain embodiments, the sensor assembly may be disposed within a downhole tool, such as the MWD assembly 107 or the steering assembly 108. FIG. 2 is a diagram illustrating a cross-section of an example downhole tool 200 comprising two sensor assemblies, according to aspects of the present disclosure. In the embodiment shown, downhole tool 200 may include two sensor assemblies 205 and 206 positioned at diametrically opposite, radially offset locations 201 and 202, respectively, from the longitudinal axis 204 of the downhole tool 200. The downhole tool 200 may include an internal bore 203 through which drilling fluid may pass during drilling operations. The sensor assemblies 205 and 206 may be located at radially offset locations 201 and 202, respectively, within the outer tubular structure of downhole tool 200.

In the embodiment shown, each of the sensor assemblies 205 and 206 may incorporate two accelerometers. Sensor assembly 205 may comprise a first accelerometer 220 oriented to sense components in a first direction 222, which may be aligned with an x-axis in an x-y plane. Sensor assembly 205 may comprise a second accelerometer 225 oriented to sense components in a second direction 227, which may be aligned with an y-axis in an x-y plane, perpendicular to the first direction 222. Sensor assembly 206 may comprise a third accelerometer 230 oriented to sense components in a third direction 232, which may be aligned with an x-axis in an x-y plane, opposite the first direction 222. Sensor assembly 206 may also comprise a fourth accelerometer 235 oriented to sense components in a fourth direction 237, which may be aligned with an y-axis in an x-y plane, perpendicular to the third direction 232 and opposite the second direction 227.

Each of the accelerometers 220, 225, 230 and 235 may sense components in the corresponding directions. When the downhole tool is not rotating, these sensed components may be used directly to determine the gravity tool face and inclination of the downhole tool 200, relative to the direction of gravity g. When the downhole tool is rotating, however, the rotational forces acting on the downhole tool 200 may skew the sensed components. These forces may include centripetal acceleration r and tangential acceleration a. Accordingly, the sensed components may need to be adjusted to eliminate the effects of the centripetal acceleration r and tangential acceleration a.

According to aspects of the present disclosure, the sensed components from the accelerometer configuration shown in FIG. 2 may be used to determine the centripetal acceleration r and tangential acceleration a of the downhole tool 200 and to determine the gravity toolface and inclination of the downhole tool 200. As will be appreciated by one of ordinary skill in the art in view of this disclosure, existing techniques may utilize as many as six accelerometers disposed in as many as three separate locations within a downhole tool. The configuration shown in FIG. 2 may be advantageous both due to the reduced number of accelerometers and to the limited number of locations in which the accelerometers must be placed. This may reduce the cost and complexity of the downhole tool 200.

As described above, the sensed components may be used to determine centripetal acceleration r and tangential acceleration a, as well as the gravity toolface and inclination of the downhole tool. In certain embodiments, the values may be determined using equations (1)-(6) below. For the purposes of equations (1)-(6), the sensed component of accelerometer 220 may be referred to as x, the sensed component of accelerometer 225 may be referred to as y, the sensed component of accelerometer 230 may be referred to as x2, and the sensed component of accelerometer 235 may be referred to as y2. The angle Θ may correspond to the gravity toolface of the downhole tool.

$$x=(g*\sin\Theta)+a; \quad \text{Eq. (1)}$$

$$x2=(-g*\sin\Theta)+a; \quad \text{Eq. (2)}$$

$$y=(-g*\cos\Theta)-r; \quad \text{Eq. (3)}$$

$$y2=(g*\cos\Theta)-r \quad \text{Eq. (4)}$$

Each of the sensed components may be a function of gravity g, the gravity toolface Θ, as well as one of the centripetal acceleration r and tangential acceleration a. Because the sensed components are known, they may be used to determine the centripetal acceleration r and tangential acceleration a using equations (5) and (6), which may be derived from equations (1)-(4).

$$a=(x+x2)/2 \quad \text{Eq. (5)}$$

$$r=-(y+y2)/2 \quad \text{Eq. (6)}$$

As will be appreciated by one of ordinary skill in the art in view of this disclosure, once the values for centripetal acceleration r and tangential acceleration a are calculated, the gravity toolface Θ may be determined using any of equations (1)-(4).

Figure 3:
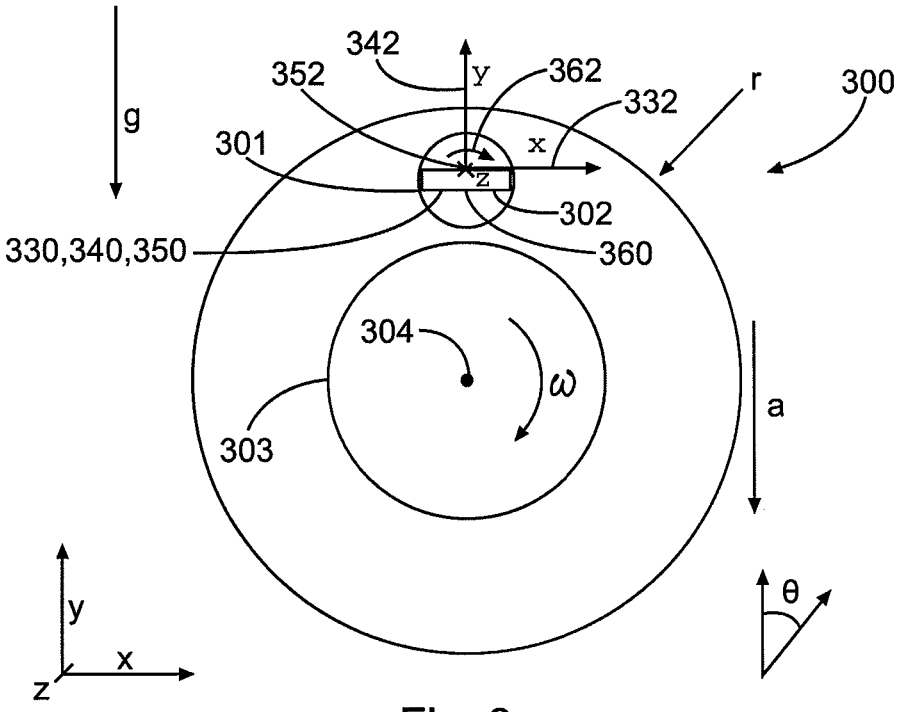
FIG. 3 is a diagram illustrating an example downhole tool, according to aspects of the present disclosure.

FIG. 3 is a diagram illustrating another example downhole tool 300, according to aspects of the present disclosure. In contrast to the downhole tool 200, the downhole tool 300 comprises a single sensor assembly 302 at a single radially offset location 301 relative to the longitudinal axis 304 of the downhole tool 300. Like downhole tool 200, downhole tool 300 may include an internal bore 303 through which drilling fluid may be pumped, and the sensor assembly 302 may be positioned in an outer tubular structure of downhole tool 300. As will be appreciated by one of ordinary skill in the art in view of this disclosure, the downhole tool 300 may be advantageous by reducing the number of sensor assemblies to one, requiring only a single radially offset location 301, which may further reduce the cost and complexity of the downhole tool 300.

The sensor assembly 302 may comprise three accelerometers 330, 340, and 350, as well as an angular rate sensing device, such as gyroscope 360. The first accelerometer 330 may be oriented to sense components in a first direction 332, which may be aligned with an x-axis in an x-y plane. The second accelerometer 340 may be oriented to sense components in a second direction 342, which may be aligned with a y-axis in an x-y plane, perpendicular to the first direction 332. The third accelerometer 350 may be oriented to sense components in a third direction 352, which may be aligned with a z-axis perpendicular to the x-y plane. The gyroscope 360 may sense angular velocity 362, which corresponds to the angular velocity co of the downhole tool 300. In certain embodiments, only two accelerometers may be used, with the two accelerometers being aligned in a plane. The sensed component in a third direction, perpendicular to the plane may be derived using geometric equations.

The accelerometers may be intended to be aligned within the directions and planes described above, but practically, they may be slightly misaligned. In certain embodiments, the accelerometers may be computationally corrected for misalignment to increase the accuracy of the resulting measurements. Each of the accelerometers 330, 340, and 350 may be corrected for misalignment in the other two orthogonal axis, as well as for tangential and centripetal acceleration. For example, accelerometer 330 may be corrected for misalignment relative to the y-axis and the z-axis, and with respect to the tangential acceleration a and the centripetal acceleration r.

As described above, each of the accelerometers 330, 340, and 350 may sense components in the corresponding directions. Like in downhole tool 200, the sensed components may be used to determine the gravity toolface Θ and inclination of the downhole tool, using equations (9) and (10) below. Unlike downhole tool 200, the centripetal acceleration r and tangential acceleration a may be determined using an angular velocity measured by the gyroscope 360, using equations (7) and (8), instead of sensed components from accelerometers. For the purposes of equations (7)-(10), the sensed component of accelerometer 330 may be referred to as x, the sensed component of accelerometer 340 may be referred to as y, the angular speed measured by gyroscope 360 may be referred to as co, the angle Θ may correspond to the gravity toolface of the downhole tool 300, and radius may be the radial distance of the angular rate sensing device 360 from a longitudinal axis 304 of the downhole tool 300.

$$r=\omega^2*\text{radius}. \quad \text{Eq. (7)}$$

$$a=((\omega_2-\omega_1)/(t_2-t_1))*\text{radius}. \quad \text{Eq. (8)}$$

As will be appreciated by one of ordinary skill in the art in view of this disclosure, the centripetal acceleration r in equation (7) may be a function of the angular speed ω and the radius of the downhole tool 300, and may be calculated directly from the output of the gyroscope 360. Likewise, the tangential acceleration a may be a function of the difference in angular speed of the downhole tool at two different times. Accordingly, the tangential acceleration a may also be calculated directly from the gyroscope 360, provided two angular speed measurements are taken at a known time interval. Once the centripetal acceleration r and tangential acceleration a are determined, the gravity tool face may be determined using equations (9) and (10).

$$x=(g*\sin\Theta)+a; \quad \text{Eq. (9)}$$

$$y=(-g*\cos\Theta)-r; \quad \text{Eq. (10)}$$

In certain embodiments, each of the sensor assemblies described herein may be implemented on a single printed circuit board (PCB), to reduce the wiring/connections necessary. For example, sensor assemblies 205 and 206 from FIG. 2 may be implemented on two separate circuit boards that communication with a single common computing device that will be described below. Likewise, sensor assembly 302 may be implemented on a single PCB that incorporates a three-axis accelerometer package as well as an angular rate sensing device, such as a gyroscope. In certain embodiments, the angular rate sensing device may comprise a gyroscope implanted in a single integrated circuit (IC) chip that can be incorporated into a PCB. This may reduce the overall design complexity and sensor assembly size within the downhole tools.

Figure 4:
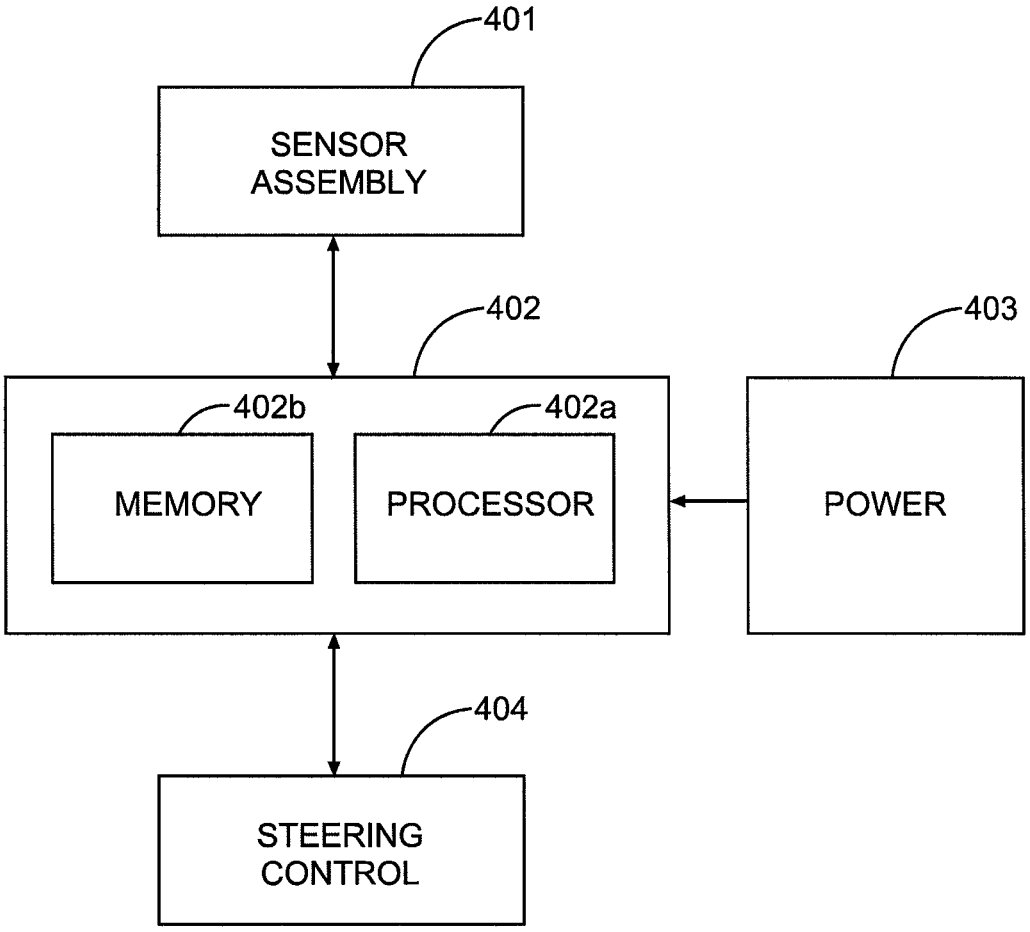
FIG. 4 is a diagram illustrating an example system, according to aspects of the present disclosure.

In certain embodiments, as can be seen in FIG. 4, determining the centripetal acceleration r, tangential acceleration a, gravity toolface, and inclination may be performed at a computing device 402 coupled to the sensor assemblies 401. The computing device may comprise at least one processor 402*a* and at least one memory device 402*b* coupled to the processor 402*a*. The computing device 402 may be in communication with each sensor assembly 401 within a downhole tool. In certain embodiments, the computing device 402 may be implemented within the downhole tool, or at some other location downhole. In certain other embodiments, the computing device 402 may be located at the surface and communicate with the sensor assemblies 401 via a telemetry system. The computing device 402 may receive power from a power source 403, which may be separate from or integrated within the computing device. In certain embodiments, the power source 403 may comprise a battery pack or generator disposed downhole that provides power to electronic equipment located within the drilling assembly.

The memory device 402*b* may contain a set of instruction that, when executed by the processor, cause the processor to receive an output from the sensor assembly 401. The output may comprise sensed components and measurements from the sensor assembly 401. In certain embodiments, the processor may also signal the sensor assembly to generate the output. Once received at the processor 402*a*, the processor may determine the centripetal acceleration r and tangential acceleration a. The processor 402*a* may then determine the gravity toolface and inclination using the determined centripetal acceleration r and tangential acceleration a. As will be appreciated by one of ordinary skill in the art in view of this disclosure, the specific equations used, and the instructions included within the memory device, to determine the centripetal acceleration r, tangential acceleration a, gravity toolface and inclination may depend on the sensor assembly configuration within the downhole tool.

In certain embodiments, at least one digital filter may be implemented within the computing device 402 to account for vibration at a drilling assembly while measurements are being taken. For example, the computing device 402 and processor 402*a* may digitally filter the sensed components received from sensor assembly. These filtered sensed components may then be used to calculate tangential acceleration a and the centripetal acceleration r. In certain other embodiments, the digital filtering may be performed on the calculated tangential acceleration a and the centripetal acceleration r rather than on the sensed components before the calculation is performed.

In certain embodiments, the computing device 402 may transmit the gravity toolface and inclination to a steering control 404. The steering control 404 may then alter the steering assembly, including altering the direction or rotation of the steering assembly based on the gravity toolface and inclination. In certain embodiments, the steering control 404 may be implemented within the computing device 402, with the memory 402*b* containing a set of instructions that controls the steering of a drilling assembly. In other embodiments, the steering control 404 may be located at the surface or at a separate location downhole, and the computing device 402 may communicate with the steering control via a wire or a telemetry system.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A system for controlling a drilling operation by determining gravity toolface and inclination, comprising:

a downhole tool comprising an internal bore through which a drilling fluid passes during a drilling operation in a borehole;

a steering assembly;

a sensor assembly disposed in a radially offset location within the downhole tool, wherein the radially offset location is relative to a longitudinal axis of the downhole tool, wherein the sensor assembly consists of a three-axis accelerometer package and an angular rate sensing device, wherein the three-axis accelerometer package comprises three accelerometers, and wherein the angular rate sensing device senses an angular velocity of the downhole tool; and a processor in communication with the sensor assembly and the steering assembly, wherein the processor is coupled to at least one memory device containing a set of instruction that, when executed by the processor, cause the processor to receive an output from the sensor assembly;

determine a centripetal acceleration of the downhole tool based, at least in part, on the output;

determine a tangential acceleration of the downhole tool based, at least in part, on a first output at a first time from the angular rate sensing device and a second output at a second time from the angular rate sensing device, wherein a digital filter is implemented to determine at least one of the centripetal acceleration and the tangential acceleration;

determine at least one of the gravity toolface and the inclination of the downhole tool using at least one of the centripetal acceleration and a tangential acceleration; and alter at least one of a direction and a rotation of the steering assembly based, at least in part, on the at least one of the gravity toolface and inclination.

2. The system of claim 1, wherein the three accelerometers comprise:

a first accelerometer oriented to sense a first component in a first direction within a plane;

a second accelerometer oriented to sense a second component in a second direction within the plane, wherein the second direction is perpendicular to the first direction; and a third accelerometer oriented to sense a third component in a third direction perpendicular to the plane.

3. The system of claim 2, wherein the angular rate sensing device comprises a gyroscope.

4. The system of claim 2, wherein the gravity toolface Θ is determined using at least one of the following equations:

$$x=(g*\sin\Theta)+a;$$

$$y=(-g*\cos\Theta)-r;$$

with x corresponding to the sensed first component from the first accelerometer, y corresponding to the sensed second component from the second accelerometer; g corresponding to the force of gravity, a corresponding to the tangential acceleration, and r corresponding to the centripetal acceleration.

5. The system of claim 2, wherein the output comprises:

the sensed first component from the first accelerometer;

the sensed second component from the second accelerometer;

the sensed third component from the third accelerometer; and an angular speed from the angular rate sensing device.

6. The system of claim 1, wherein:

the centripetal acceleration is determined using the following equation:

$$r=\omega^2*\text{radius},$$

where r corresponds to the centripetal acceleration, ω corresponds to an angular speed output of the angular rate sensing device, and radius corresponds to a radial distance of the angular rate sensing device from a longitudinal axis of the downhole tool; and the tangential acceleration is determined using the following equation:

$$a=((\omega_2-\omega_1)/(t_2-t_1))*\text{radius}$$

where a corresponds to the tangential acceleration, $\omega_2$ corresponds to an angular speed output of the angular rate sensing device at time $t_2$, $\omega_1$ corresponds to an angular speed output of the angular rate sensing device at time $t_1$, and radius corresponds to a radius of the downhole tool.

7. The system of claim 1, wherein the sensor assembly is implemented on a single printed circuit board (PCB).

8. The system of claim 7, wherein the angular rate sensing device comprises a gyroscope implemented in a single integrated circuit chip coupled to the PCB.

9. A method for controlling a drilling operation by determining gravity toolface and inclination, comprising:

positioning a downhole tool comprising an internal bore through which a drilling fluid passes during a drilling operation within a borehole, wherein:

the downhole tool comprises a sensor assembly disposed, wherein the sensor assembly is in a radially offset location within the downhole tool, wherein the radially offset location is relative to a longitudinal axis of the downhole tool;

the downhole tool comprises a steering assembly; and the sensor assembly consisting of a three-axis accelerometer package and an angular rate sensing device, wherein the three-axis accelerometer package comprises three accelerometers, wherein the angular rate sensing device senses an angular velocity of the downhole tool;

determining a centripetal acceleration of the downhole tool based, at least in part, on an output of the sensor assembly;

determining a tangential acceleration of the downhole tool based, at least in part, on a first output at a first time from the angular rate sensing device and a second output at a second time from the angular rate sensing device, wherein a digital filter is implemented to determine at least one of the centripetal acceleration and the tangential acceleration;

determining at least one of the gravity toolface and the inclination of the downhole tool using at least one of the centripetal acceleration and a tangential acceleration;

transmitting the at least one of the gravity toolface and the inclination to a steering control, wherein the steering control alters at least one of a direction and a rotation of the steering assembly based, at least in part, on the at least one of the gravity toolface and the inclination.

10. The method of claim 9, wherein the three accelerometers comprise:

a first accelerometer oriented to sense a first component in a first direction within a plane; and a second accelerometer oriented to sense a second component in a second direction within the plane, wherein the second direction is perpendicular to the first direction.

11. The method of claim 10, further comprising a third accelerometer of the three accelerometers oriented to sense a third component in a third direction perpendicular to the plane.

12. The method of claim 10, wherein:

the centripetal acceleration is determined using the following equation:

$$r=\omega^2*\text{radius},$$

where r corresponds to the centripetal acceleration, ω corresponds to an angular speed output of the angular rate sensing device, and radius corresponds to a radial distance of the angular rate sensing device from a longitudinal axis of the downhole tool;

the tangential acceleration is determined using the following equation:

$$a=((\omega_2-\omega_1)/(t_2-t_1))*\text{radius}$$

where a corresponds to the tangential acceleration, $\omega_2$ corresponds to an angular speed output of the angular rate sensing device at time $t_2$, $\omega_1$ corresponds to an angular speed output of the angular rate sensing device at time $t_1$, and radius corresponds to a radius of the downhole tool; and the gravity toolface Θ is determined using at least one of the following equations:

$$x=(g*\sin\Theta)+a;$$

$$y=(-g*\cos\Theta)-r;$$

with x corresponding to the sensed first component from the first accelerometer, y corresponding to the sensed second component from the second accelerometer; g corresponding to the force of gravity, a corresponding to the tangential acceleration, and r corresponding to the centripetal acceleration.

13. A system for controlling a drilling operation by determining gravity toolface and inclination, comprising:

a downhole tool comprising an internal bore through which a drilling fluid passes during a drilling operation in a borehole;

a steering assembly;

a first sensor assembly disposed in a first radially offset location within the downhole tool, wherein the first radially offset location is relative to a longitudinal axis of the downhole tool, wherein the first sensor assembly is implemented on a first printed circuit board (PCB), wherein the first sensor assembly consists of a first accelerometer and a second accelerometer;

a second sensor assembly disposed in a second radially offset location within the downhole tool, wherein the second radially offset location is relative to a longitudinal axis of the downhole tool, wherein the second sensor assembly is implemented on a second PCB, wherein the second sensor assembly consists of a third accelerometer and a fourth accelerometer; and a processor in communication with the steering assembly, the first sensor assembly, and the second sensor assembly, wherein the processor is coupled to at least one memory device containing a set of instruction that, when executed by the processor, cause the processor to:

receive a first output from the first sensor assembly;

receive a second output from the second sensor assembly;

determine a centripetal acceleration of the downhole tool based, at least in part, on the first output and the second output;

determine a first tangential acceleration of the downhole tool based, at least in part, on the first output, wherein a digital filter is implemented to determine at least one of the centripetal acceleration and the first tangential acceleration;

determine at least one of the gravity toolface and the inclination of the downhole tool using at least one of the centripetal acceleration and a tangential acceleration; and alter at least one of a direction and a rotation of the steering assembly based, at least in part, on the least one of the gravity toolface and inclination.

14. The system of claim 13, wherein:

the first accelerometer is oriented to sense a first component in a first direction within a plane;

the second accelerometer is oriented to sense a second component in a second direction within the plane, wherein the second direction is perpendicular to the first direction;

the third accelerometer is oriented to sense a third component in a third direction within the plane, wherein the third direction is opposite the first direction;

the fourth accelerometer is oriented to sense a fourth component in a fourth direction within the plane, wherein the fourth direction is perpendicular to the third direction and opposite the second direction.

15. The system of claim 14, wherein:

the centripetal acceleration is determined using the following equation:

$$r=-(y+y2)/2$$

where r corresponds to the centripetal acceleration, y corresponds to a second sensed component from the second accelerometer, and y2 corresponds to the fourth sensed component from the fourth accelerometer; and a second tangential acceleration is determined using the following equation:

$$a=(x+x2)/2$$

where a corresponds to the tangential acceleration, x corresponds to a first sensed component from the first accelerometer, and x2 corresponds to the third sensed component from the third accelerometer.

16. The system of claim 15, wherein the gravity toolface Θ is determined using at least one of the following equations:

$$x=(g*\sin\Theta)+a;$$

$$x2=(-g*\sin\Theta)+a;$$

$$y=(-g*\cos\Theta)-r;$$

$$y2=(g*\cos\Theta)-r$$

with x corresponding to a first sensed component from the first accelerometer, x2 corresponding to the third sensed component from the third accelerometer, y corresponding to a second sensed component from the second accelerometer, y2 corresponding to the fourth sensed component from the fourth accelerometer; g corresponding to the force of gravity, a corresponding to the tangential acceleration, and r corresponding to the centripetal acceleration.

17. The system of claim 14 wherein the output comprises:

the sensed first component from the first accelerometer;

the sensed second component from the second accelerometer;

the sensed third component from the third accelerometer; and the sensed fourth component from the fourth accelerometer.

18. The system of claim 13, wherein the first sensor assembly is implemented on a first printed circuit board (PCB).

* * * * *